United States Patent [19]

Fritsch

[11] Patent Number: 4,544,215

[45] Date of Patent: Oct. 1, 1985

[54] SELF-CONTAINED SLIP RING ASSEMBLY

[76] Inventor: Joseph E. Fritsch, 14001 Sherwood, Oak Park, Mich. 48237

[21] Appl. No.: 521,587

[22] Filed: Aug. 9, 1983

[51] Int. Cl.[4] ..... H01R 39/08; H01R 39/38

[52] U.S. Cl. ..... 339/5 M; 310/239; 339/8 R

[58] Field of Search ..... 339/5, 6 R, 8 R; 310/232, 239; 277/187

[56] References Cited

U.S. PATENT DOCUMENTS

| | | | |
|---|---|---|---|
| 1,392,193 | 9/1921 | Mills | 310/232 |
| 1,661,014 | 2/1928 | Schmock | 310/232 |
| 1,926,264 | 9/1933 | Connors | 339/5 A X |
| 2,371,528 | 3/1945 | Levetus et al. | 285/97.3 |
| 3,059,202 | 10/1962 | Huber | 339/5 |
| 3,185,951 | 5/1965 | Le Beau | 339/5 |
| 3,387,155 | 6/1968 | Krulls | 310/239 |
| 3,509,399 | 4/1970 | Brucker | 310/242 |
| 3,559,539 | 2/1971 | Nagy | 277/187 X |
| 4,209,213 | 6/1980 | Wussow | 339/5 R |
| 4,329,004 | 5/1982 | Lewis | 339/5 P X |

*Primary Examiner*—Eugene F. Desmond

[57] ABSTRACT

A self-contained slip ring assembly comprising a tubular rotor having sections of differing wall thicknesses supporting slip rings on the non-structural, thin-walled section. A thick-walled section supports those components requiring structural integrity such as the single bearing on which the non-rotating housing is mounted. The said bearing is held in position by clamping means thereby allowing easy disassembly for inspection or service. The said housing supports a generally cylindrical shaped brush block assembly utilizing a unique frictional creating means which permits the removal of the brush block assembly for inspection or service without the use of tools and, also, greatly simplifies the machining required for the housing body. An easily serviceable seal design is employed thereby permitting the matching of the seal to the environment in which the present invention is to be used.

18 Claims, 7 Drawing Figures

SELF-CONTAINED SLIP RING ASSEMBLY

TECHNICAL FIELD

The present invention relates generally to slip ring assemblies and more particularly to a unique single bearing self-contained slip ring assembly which is highly reliable, easy to maintain and less costly to manufacture.

BACKGROUND OF THE INVENTION

Slip ring assemblies are well known and have widespread use where a plurality of electrical circuits must be maintained between a rotating member and a fixed member. It is well known by those skilled in the art, that a small, slowly rotating slip ring operating in a clean environment is very reliable and causes few problems. Conversely, high slip ring surface speed, unstable brush members and contaminents are some of the conditions that contribute to electrical noise or poor signal quality.

Most manufacturers of slip ring assemblies used for instrumentation, use a plurality of brushes mated to each slip ring in an effort to alleviate these problems. Also, if the end of the rotating member is accessible, a miniature slip ring assembly such as U.S. Pat. No. 3,185,951, can be attached to the end of the rotating member, thereby greatly reducing the slip ring surface speed.

U.S. Pat. No. 3,226,666 and U.S. Pat. No. 3,509,399 show slots incorporated into these designs in an effort to remove contaminents.

Brush lifters are well known and are frequently used to hold the brush members away from the slip rings during time periods when an electrical connection to the rotating member is not required. An example is shown in U.S. Pat. No. 1,661,014.

Another consideration is the case of cleaning, inspection and maintenance; especially in the case of a slip ring assembly which must be mounted on the rotating member itself. For example, on a drive shaft connecting a prime mover with some type of apparatus. In this example the slip rings must necessarily be larger in diameter than the rotating member. It is this type of application with which the present invention is primarily concerned.

DISCLOSURE OF THE INVENTION

This invention relates to a novel structure for providing an improved self-contained slip ring assembly which is more reliable, trouble-free and easier to service than prior apparatus of the same general type and that requires fewer parts, fewer machining operations, fewer and easier assembly operations and therefore, is relatively inexpensive to manufacture.

It is therefore a principal object of the present invention to provide a self-contained slip ring assembly which includes slip rings which are only slightly larger in diameter than the rotating body on which the present invention is mounted.

Another object of the present invention is to provide a self-contained slip ring assembly which includes an improved means of holding a brush block which allows said brush block to be removed for inspection or cleaning, without the use of tools.

It is another object of the present invention to provide a self-contained slip ring assembly which can be disassembled without the need of pressing out the bearing.

It is a further object of the present invention to provide a self-contained slip ring assembly with easily removable seals which are inexpensive and simple to install and which can be matched to the environment in which the present invention will be used.

It is a still further object of the present invention to provide a self-contained slip ring assembly with wiring which is easily accessible.

These and other objects, features and advantages of this invention will be more apparent from a study of the appended drawings in which.

DETAILED DESCRIPTION OF THE PREFERRED EMBODIMENTS

Figure 1:
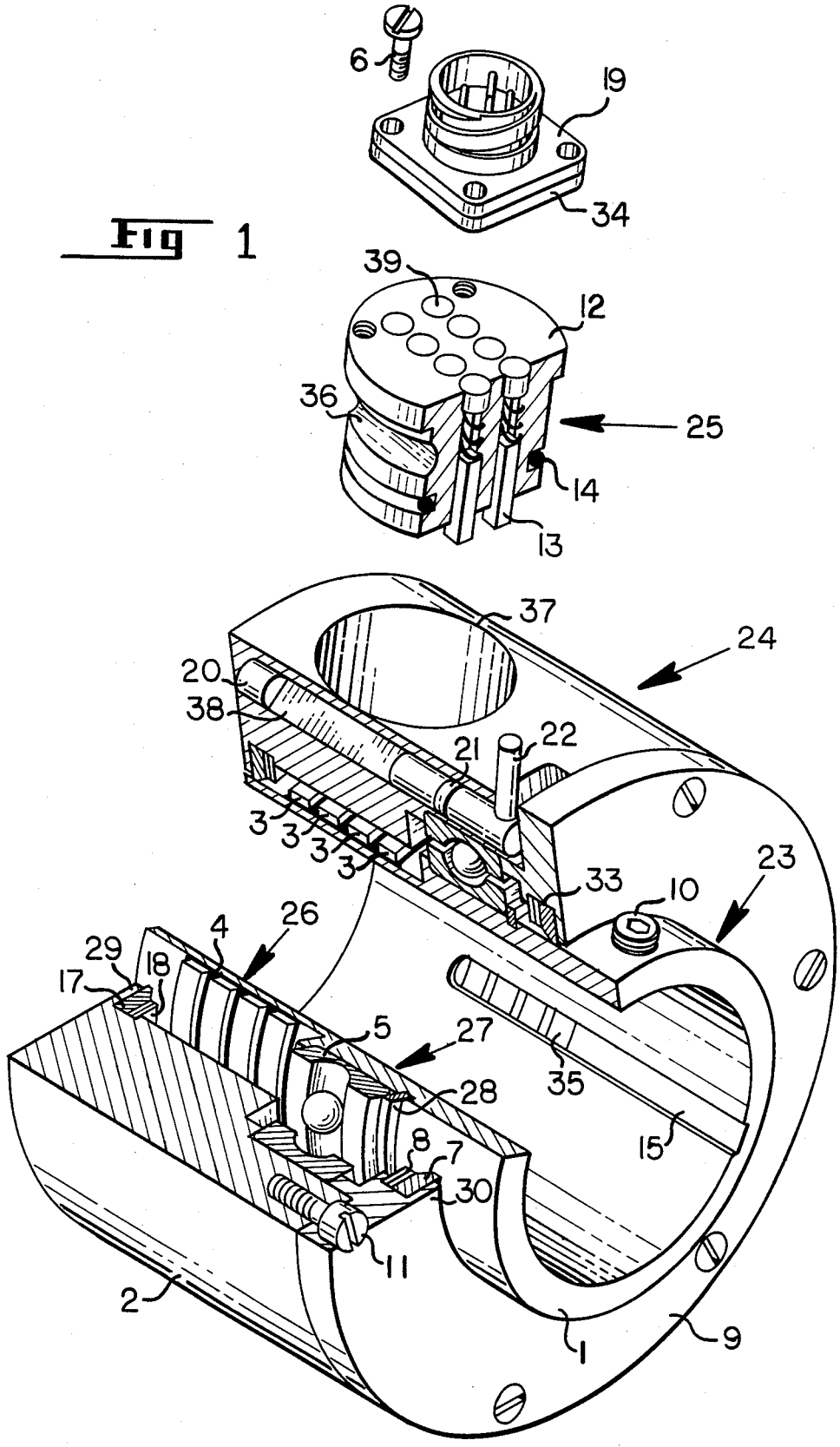
FIG. 1 is a perspective view of a preferred embodiment and is shown partly exploded and in section for clarity.

Referring now to FIG. 1 in which a preferred embodiment of the self-contained slip ring assembly incorporating the invention is shown. The self-contained slip ring assembly consists of three main sub-assemblies:

A. The rotor assembly, generally indicated at 23.

B. The housing assembly, generally indicated at 24.

C. The brush block assembly, generally indicated at 25.

The rotor assembly consists of a tubular shaft 1 which is mounted on the rotating member (not shown) and is secured to the rotating member by suitable means such as set screws 10 (not shown). The tubular shaft has two areas of differeing wall thickness, a thin-walled section generally indicated at 26 and a thick-walled section generally indicated at 27. The thin-walled section holds a plurality of slip rings 3 in axially spaced relationship. Four slip rings are shown, but it must be appreciated that more than four or less than four slip rings could be used. The thin-walled section of the tubular shaft is an important feature of the present invention, in that it permits the use of slip rings which are only slightly larger than the rotating member on which the tubular shaft is mounted. This is essential in order to keep the surface speed of the slip rings to a minimum. The slip rings are electrically conductive and are insulated from the tubular shaft and each other by insulating material 4. It must be appreciated that if the tubular shaft is made of a non-conductive material, the slip rings would only need to be electrically insulated from each other.

The thick-walled section 27 of the tubular shaft provides enough strength to support all the components requiring structural integrity. This includes the bearing 5, the bearing retaining ring 28, and the securing means 10. An axial groove 15 on the inside surface of the tubular shaft provides electrical access to the slip rings and also provides a path for the electrical lead wires. The electrical lead wires (not shown) are connected directly to the inside surface 35 of the slip rings by suitable means such as soldering without having an intermediate electrical means between the slip rings and the lead wires. The depth of groove 15 is slightly more than the wall thickness of the thin-walled section of the rotor shaft, thereby providing both a groove in the thick-walled section 27 and an access opening in the thin-walled section 26 with only one machining operation. This groove design is an important feature of the present invention because it permits free access for electrical connections or repair and yet the slip rings and lead wires are completely protected while in use by the rotating member on which the present invention is mounted.

The housing assembly 24 is usually supported in a stationary position and includes the housing body 2, the end cap 9, and the locking cam 20. The housing assembly 24 is rotatably supported on rotor assembly 23 by means of bearing 5. The seal used to prevent moisture and debris from entering the assembly is also an important advantage of the present invention. A flange 29 is an integral part of the housing body 2 and is used as the seal outer support frame. A yieldable material 17 is used as the sealing member. A spiral retaining ring 18 holds the yieldable material in place in the housing body and also serves as the seal inner support frame. This unique seal design facilitates easy seal replacement and avoids the necessity of having equipment to press a standard seal into the housing body. This seal design also permits the use of a variety of non-standard sealing materials which can be matched to the environment in which the present invention is to be used.

The housing body 2 is provided with an aperture 37 whose axis is perpendicular to the major axis of the rotor assembly and centered above the slip rings 3. The brush block assembly 25 is slidably disposed within this aperture. The locking cam 20 is rotatably disposed within a hole which is bored into but not through, the housing body. The longitudinal axis of this hole is parallel to the major axis of the rotor assembly and the centerline of this hole intersects the edge of aperture 37. The locking cam has a generally cylindrical shape with a flattened area 38 immediately adjacent to aperture 37. (This flattened area is rotated out of true position in FIG. 1 for clarity.) A ring of yieldable material, such as an O-ring 21, is disposed within a circumferential groove in the locking cam and serves the dual function of a sealing means and a friction producing means which provides rotorary resistance to the locking cam. A lever 22, rigidly affixed and extending perpendicular to the longitudinal axis of the locking cam, is used as the means to rotate the locking cam. It should be appreciated that if more slip rings were required, multiple brush blocks of the same size could be used. If these multiple brush blocks were in line, one elongated locking cam could service all the brush blocks. This, in turn, would permit the use of a standardized brush block such as an injection moulded part which could be used for any size slip ring assembly.

Figure 2:
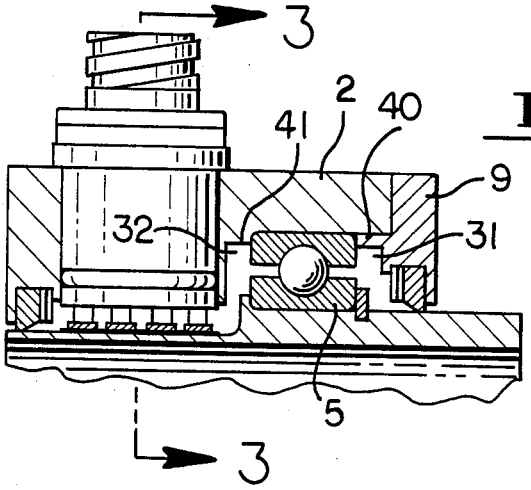
FIG. 2 is a sectional view showing the upper portion of the preferred embodiment.

Referring now to FIG. 2, the housing body 2 contains reservoirs 31 and 32 on either side of bearing 5. These reservoirs are so designed that any contaminant material, such as lubricant or debris, thrown or leaked from the bearing by centrifugal force or any other means, will be trapped in the reservoirs and thus be prevented from contaminating the slip ring contact surfaces. It must be appreciated that drain holes could be provided in the housing body to drain excess fluid from these reservoirs.

Referring back to FIG. 1, the end cap 9 is secured in place on the housing body 2 by suitable securing means such as a plurality of screws 11. The end cap also incorporates an integral seal. The seal outer support flange 30 is part of the end cap. A groove 33 in the end cap holds the yieldable material 7 and also holds the spiral retaining ring 8 which serves as the seal inner support frame. The end cap also serves to retain the locking cam 20 in the housing body.

Referring now to FIG. 2, the means used to hold the bearing 5 in the housing body is another important advantage of the present invention and is one reason why a single bearing design was used. The bearing mounting tolerances are less critical and more outside diameter clearance can be tolerated with a single bearing than with a multiple bearing design since the geometric imperfections normally found in a multiple bearing design are eliminated. In addition, the ratio of the pitch diameter of the bearing to the distance between the bearing and slip ring is large, thus the resulting moment load is low and one bearing can easily support this load. This permits the improved method of mounting the bearing 5 which consists of claimping the outer race of the bearing between flange 40 of the end cap 9 and offset 41 of the housing body 2. Additional clearance has been provided around the outside diameter of the bearing since the bearing does not need the normally used press fit to prevent rotation in the housing body nor must the bearing be closely aligned with another bearing. This unique bearing mounting means permits disassembly of the present invention by removing the end cap 9 and sliding the housing body 2 from the bearing rather than pressing the housing body from the bearing with the associated possibility of damage to the components; thus, inspection and cleaning of the slip rings is simplified. It must be appreciated that in the event that the thin-walled section of the rotor assembly was made wider to accomodate more slip rings and more rotatary support was required, more than one bearing could be mounted on the thick-walled section of the rotor assembly in place of the single bearing.

Referring back to FIG. 1, the brush block assembly 25 consists of a brush block body 12, brush members 13, an electrical connector 19, and a gasket 34. The brush block body 12 has a generally cylindrical shape and is formed of any suitable plastic insulating material. A plurality of passages are arranged in axially spaced apart relationship through the brush block body. A spring biased brush member 13 is slidably disposed in each of these passages. This biasing pressure on the brush member causes the brush member to extend outwardly from one end of the brush block body to electrically engage the slip rings 3. Although two brush members are shown for each slip ring it must be appreciated that less than two or more than two could be used. The electrical connector 19 is secured to the brush block body 12 by suitable means such as screws 6 (one shown). The base of the electrical connector serves to retain the brush member 13 in position. The gasket 34 is made of a yieldable electrical insulating material and provides paths for the electrical connector lead wires (not shown) which are secured to the top surface 39 of the brush members by any suitable means such as soldering.

A ring of yieldable material, such as an O'ring 14 is disposed in a circumferential groove around the brush block body. This ring serves the dual purpose of sealing moisture and contaminants out of the assembly and of being a friction creating means between the brush block body and the housing body. This friction in combination with the locking cam eliminates the need for fasteners to hold the brush securely in position. The cylindrical shape of the brush block body and the elimination of the fasteners greatly simplifies the machining required for the housing body and is an important feature of the present invention.

Figure 3:
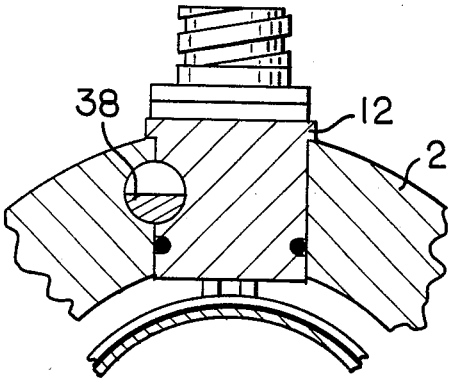
FIG. 3 is a sectional view taken along line 3—3 of FIG. 2.

The brush block body is held in proper orientation with the slip rings by means of a groove 36 in the brush block which conforms to the shape of the locking cam when the said locking cam is rotated to the locked position. Referring now to FIG. 3, which is a sectional view taken through line 3—3 in FIG. 2, the flattened area 38 of the locking cam has been rotated to the locked position thereby preventing the brush block body 12 from being removed from or rotated in the housing body 2.

Figure 4:
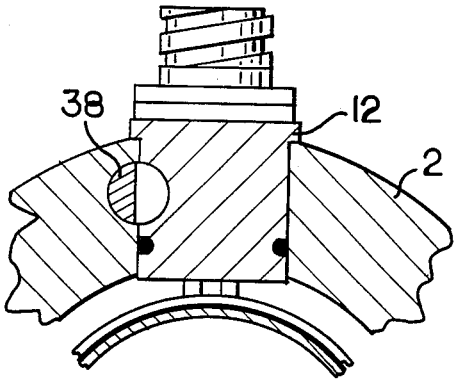
FIG 4 is a sectional view generally similar to FIG. 3.

Referring now to FIG. 4, which is the same sectional view as FIG. 3, with the exception of having the flattened area 38 of the locking cam rotated clear of the brush block body 12, thereby permitting the brush block assembly to be removed for cleaning, repair or replacement without the use of tools. It must be appreciated that while the brush block assembly is removed, it could be replaced in the aperture with a dust cap which could be held in place with the locking cam.

Figure 5:
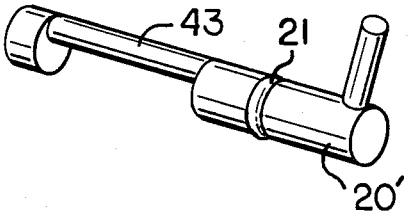
FIG. 5 is a perspective view of a second, preferred embodiment of the locking cam.
Figure 6:
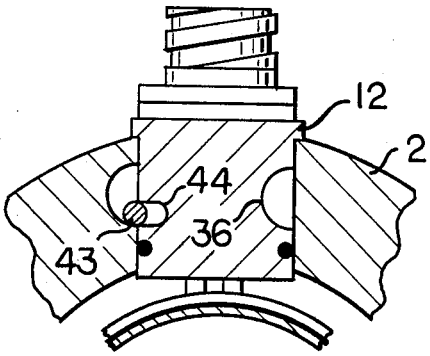
FIG. 6 is a sectional view generally similar to FIG. 3, showing the second preferred embodiment.

Referring now to FIG. 5, which is a perspective view of a second preferred embodiment of the locking cam 20' in which the flattened area has been replaced by a cylindrical section 43 which is parallel to the major axis of the locking cam but offset to one edge. Referring now to FIG. 6, which is the same sectional view as FIG. 3, with the exception of showing the second preferred embodiment. The brush block body 12 is shown rotated 180°, putting the brush block groove 36 on the side opposite the locking cam. A second groove 44 which has been formed in the brush block body 12 slidably fits around the cylindrical section 43 of the locking cam which is shown in the bottom center position. With the cylindrical section 43 in the bottom center position, the brush block assembly is locked in the down or brush electrical contact position.

Figure 7:
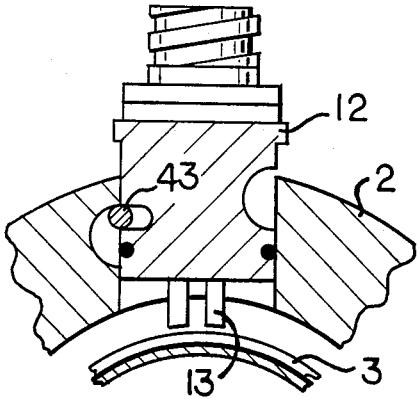
FIG. 7 is a sectional view generally similar to FIG. 6.

Referring now to FIG. 7, which is the same sectional view as FIG. 6, with the exception of having the cylindrical section 43 of the locking cam rotated to the top center position. In this position, the brush block assembly is raised and the brush members 13 no longer make physical or electrical contact with the slip rings 3. This permits the rotor assembly to revolve without wearing or contaminating the slip rings or brush members. In this position, the locking cam still prohibits the removal of the brush block assembly but further rotation of the locking cam would permit removal of the brush block assembly from the housing body 2. It must be appreciated that rotation of the locking cam could be by manual or remote control, using electrical or mechanical means.

While the above description contains many specificities, these should not be construed as limitations on the scope of the invention, but rather as an exemplification of the preferred embodiment thereof. Many other variations are possible, for example, the locking cam 20 shown in FIG. 1 could be replaced with a detent mechanism. Likewise, the location of flange 29 could be interchanged with spiral retaining ring 18 shown in FIG. 1, thereby locating the spiral retaining ring external to yieldable material 17.

What is claimed as new and desired to be secured by letters patent is:

1. A self-contained slip ring assembly comprising:
a rotor;
a plurality of electrically conductive slip rings axially spaced apart on said rotor;
a housing rotatably supported by said rotor;
said housing slidably retaining a generally cylindrical brush block assembly by frictional engagement means;
the axis of said brush block assembly is substantially perpendicular to the major axis of said rotor;
said housing including a brush block assembly aligning means;
said brush block assembly including a brush block body;
a pluarlity of passages arranged in axially spaced apart relationship through said brush block body;
a spring biased brush member slidably disposed in each said passage, extending outwardly from one end of said brush block body to slidably engage said slip rings so as to insure an electrical connection therebetween.

2. The self-contained slip ring assembly as defined in claim 1 wherein said brush block body is formed of an electrically insulated material.

3. The self-contained slip ring assembly as defined in claim 1 wherein the said frictional engagement means is further defined as a ring of yieldable material disposed in a circumferential groove around said brush block body.

4. The self-contained slip ring assembly as defined in claim 1 wherein the said brush block assembly aligning means is a locking cam.

5. The self-contained slip ring assembly as defined in claim 4 wherein the said locking cam is held in rotatable position by a friction creating means.

6. The self-contained slip ring assembly as defined in claim 1 wherein the said housing includes a means to axially shift the said brush block assembly.

7. The self-contained slip ring assembly as defined in claim 6 wherein the said axially shift means is further defined as including an offset member whose axis is parallel to the axis of the said axially shift means, said axially shift means held in rotatable position by friction creating means.

8. A self-contained slip ring assembly comprising:
a rotor having a generally tubular shape of two, substantially differing, wall thicknesses;
a plurality of electrically conductive slip rings axially spaced apart on the thin-walled section of said rotor;
said rotor having electrical access means to said slip rings;
a housing rotatably supported by the thick-walled section of said rotor;
an end cap secured to said housing;
a first and second sealing means respectively slidably sealing said housing and said end cap to said rotor for defining an enclosed, relatively clean chamber around said slip rings;
said housing slidably retaining a generally cylindrical brush block assembly by frictional engagement means;
the axis of said bruch block assembly being substantially perpendicular to the major axis of said rotor;
said housing having a brush block assembly aligning means;
said brush block assembly including a brush block body, a plurality of passages arranged in axially spaced apart relationship through said brush block body;

a spring biased brush member slidably disposed in each of said passages, extending outwardly from one end of said brush block body to slidably engage said slip rings so as to insure an electrical connection therebetween.

9. The self-contained slip ring assembly defined in claim 8 wherein the said tubular rotor is formed of an electrically insulated material.

10. The self-contained slip ring assembly as defined in claim 8 wherein the first sealing means includes:

a circumferential seal flange member extending inwardly and integral with said housing;

a retaining means firmly holding a yieldable sealing member disposed between said flange member and said retaining means.

11. The self-contained slip ring assembly as defined in claim 8 wherein the second sealing means includes:

a circumferential seal flange member extending inwardly and integral with said end cap;

a retaining means firmly holding a yieldable sealing member disposed between said flange member and said retaining means.

12. The self-contained slip ring assembly as defined in claim 8 wherein the said brush block body is formed of an electrically insulated material.

13. The self-contained slip ring assembly as defined in claim 8 wherein the said brush block assembly aligning means is further defined as a locking cam.

14. The self-contained slip ring assembly as defined in claim 13 wherein the said locking cam is held in rotatable position by friction creating means.

15. The self-contained slip ring assembly as defined in claim 8 wherein the housing includes a means to axially shift the said brush block assembly.

16. The self-contained slip ring assembly as defined in claim 15 wherein the said axially shift means is further defined as including an offset member whose axis is parallel to the axis of the said axially shift means which is held in rotatable position by friction creating means.

17. The self-contained slip ring assembly as defined in claim 14 wherein said brush block assembly includes an electrical connector which serves as a brush member retainer means.

18. The self-contained slip ring assembly as defined in claim 8 wherein said electrical access means includes an axial groove in said tubular rotor.

* * * * *